US006138899A

United States Patent [19]

Grabher

[11] Patent Number: 6,138,899

[45] Date of Patent: Oct. 31, 2000

[54] INSERTED LID, BOX WITH SAID LID AND PROCESS FOR THE PRODUCTION OF SAID LID

[76] Inventor: Werner Grabher, Oberwingerstrasse 8, CH-9436 Balgach, Switzerland

[21] Appl. No.: 09/178,649

[22] Filed: Oct. 26, 1998

[30] Foreign Application Priority Data

Oct. 25, 1997 [EP] European Pat. Off. ..... 97118584

[51] Int. Cl.[7] ..... B65D 3/10; B65D 5/00

[52] U.S. Cl. ..... 229/5.5; 229/4.5; 220/789; 220/801; 220/624; 220/609

[58] Field of Search ..... 220/780, 789, 220/801, 305, 790, 802, 624, 609; 229/5.5, 4.5, 5.7, 125.17

[56] References Cited

U.S. PATENT DOCUMENTS

| | | | |
|---|---|---|---|
| 1,086,007 | 2/1914 | Wollitzer . | |
| 1,208,483 | 12/1916 | Chesbrough . | |
| 1,272,789 | 7/1918 | Ford . | |
| 1,454,846 | 5/1923 | Coates . | |
| 1,595,304 | 8/1926 | Hulbert . | |
| 1,750,204 | 3/1930 | Wichner . | |
| 1,758,691 | 5/1930 | Holliens | 220/801 |
| 1,790,068 | 1/1931 | Murphy . | |
| 1,808,975 | 6/1931 | Wright . | |
| 1,867,288 | 7/1932 | Thomas . | |
| 1,913,880 | 6/1933 | Hoffman | 229/5.5 X |
| 1,924,863 | 8/1933 | Koch et al. . | |

(List continued on next page.)

FOREIGN PATENT DOCUMENTS

| | | |
|---|---|---|
| 0007487 | 2/1980 | European Pat. Off. . |
| 0241026 | 10/1987 | European Pat. Off. . |
| 0611703 | 8/1994 | European Pat. Off. . |
| 1593395 | 7/1970 | France . |
| 2219066 | 9/1974 | France . |
| 2289394 | 5/1976 | France . |
| 881899 | 7/1953 | Germany . |
| 8108034 | 7/1984 | Germany . |
| 4234857 | 4/1994 | Germany . |
| 9414440 | 1/1995 | Germany . |
| 60-24238 | 2/1985 | Japan . |
| 642316 | 4/1984 | Switzerland . |
| 659633 | 2/1987 | Switzerland . |
| 8404507 | 11/1984 | WIPO . |

*Primary Examiner*—Allan N. Shoap
*Assistant Examiner*—Tri M. Mai
*Attorney, Agent, or Firm*—Rothwell, Figg, Ernst & Manbeck

[57] ABSTRACT

An inserted lid (1) for a box (2) is formed so that a contact region (5) can be pressed against the inside of the side wall of the box. In the non-inserted state, said side wall is slightly larger than the box opening (4). On insertion of the lid (1) into the box (2), the largest circumferential line of the contact region (5) must fit the inside of the side wall of the box as a result of an elastic deformation of the closure surface (3). To prevent the forces emanating on insertion from the side wall of the box from leading to irreversible deformations, the closure surface (3) has spring properties which are radial with respect to the contact region (5) and permit an elastic deformation of the contact region (5) in the radial direction. To ensure these spring properties, the closure surface (3) has a shape differing from a flat surface, in particular two concentric waves (7) formed constant distances away from the contact region (5) and/or a central vault (8). On insertion of the lid (1), this difference is slightly increased by the compression of the contact region (5), or the waves (7) and the vault (8) are slightly deformed, which leads to storing forces which press the contact region (5) against the inside of the side wall of the box. Owing to the shape imposed on the closure surface (3), it is ensured that no creases or other irreversible deformations form on insertion of the lid (1).

12 Claims, 3 Drawing Sheets

U.S. PATENT DOCUMENTS

| | | | |
|---|---|---|---|
| 1,947,190 | 2/1934 | Cody . | |
| 2,006,952 | 7/1935 | Klein . | |
| 2,027,231 | 1/1936 | Hutt et al. . | |
| 2,037,675 | 4/1936 | Boothby et al. . | |
| 2,074,899 | 3/1937 | Gazette | 229/5.5 |
| 2,109,716 | 3/1938 | Annen . | |
| 2,110,616 | 3/1938 | Wilcox | 229/5.5 |
| 2,120,898 | 6/1938 | Moore . | |
| 2,126,159 | 8/1938 | Wilcox | 229/5.5 |
| 2,150,308 | 3/1939 | Annen . | |
| 2,226,178 | 12/1940 | Page . | |
| 2,269,785 | 1/1942 | Rigerman | 229/5.5 |
| 2,314,338 | 3/1943 | Graves et al. | 229/5.5 |
| 2,336,852 | 12/1943 | Elmendorf . | |
| 2,355,108 | 8/1944 | Reese | 229/5.5 |
| 2,493,086 | 1/1950 | Reifsnyder . | |
| 2,505,748 | 5/1950 | Barbieri . | |
| 2,551,090 | 5/1951 | Bergstein . | |
| 2,671,593 | 3/1954 | Page . | |
| 2,858,037 | 10/1958 | Rose . | |
| 3,135,451 | 6/1964 | Bauder et al. | 229/5.5 |
| 3,157,336 | 11/1964 | Elam . | |
| 3,204,849 | 9/1965 | Vinney . | |
| 3,215,325 | 11/1965 | Shappell et al. . | |
| 3,288,341 | 11/1966 | Krause . | |
| 3,344,974 | 10/1967 | Bostrom . | |
| 3,377,014 | 4/1968 | Röcher . | |
| 3,402,874 | 9/1968 | Sternau . | |
| 3,473,691 | 10/1969 | Asmus et al. | 229/5.5 |
| 3,498,521 | 3/1970 | Gill . | |
| 3,700,018 | 10/1972 | Goglio . | |
| 3,712,530 | 1/1973 | Croley . | |
| 3,912,154 | 10/1975 | Godar . | |
| 3,935,615 | 2/1976 | Wakeman . | |
| 3,937,392 | 2/1976 | Swisher . | |
| 4,042,164 | 8/1977 | Croley . | |
| 4,044,941 | 8/1977 | Knudsen . | |
| 4,094,457 | 6/1978 | Spillson . | |
| 4,109,822 | 8/1978 | Egli . | |
| 4,109,848 | 8/1978 | Kipp et al. . | |
| 4,153,196 | 5/1979 | Dutcher . | |
| 4,157,147 | 6/1979 | Deforest et al. . | |
| 4,289,265 | 9/1981 | Ellerbrock . | |
| 4,299,350 | 11/1981 | Woerz . | |
| 4,331,255 | 5/1982 | Fourmer . | |
| 4,341,337 | 7/1982 | Beach, Jr. et al. . | |
| 4,495,209 | 1/1985 | Whiteside . | |
| 4,527,699 | 7/1985 | Namba et al. . | |
| 4,557,414 | 12/1985 | Ford et al. . | |
| 4,560,063 | 12/1985 | Muller | 229/5.5 |
| 4,564,139 | 1/1986 | Reil . | |
| 4,595,119 | 6/1986 | Cho . | |
| 4,599,123 | 7/1986 | Christensson . | |
| 4,706,874 | 11/1987 | Reil . | |
| 4,736,885 | 4/1988 | Negus, Sr. . | |
| 4,760,935 | 8/1988 | Van Den Beld et al. | 220/789 |
| 4,799,590 | 1/1989 | Furman . | |
| 4,850,506 | 7/1989 | Heaps, Jr. et al. . | |
| 4,852,793 | 8/1989 | Homma et al. . | |
| 5,074,099 | 12/1991 | Andersson et al. . | |
| 5,152,418 | 10/1992 | Kroeschell et al. . | |
| 5,161,711 | 11/1992 | Picozza et el. | 220/789 X |
| 5,385,255 | 1/1995 | Varano et al. . | |
| 5,398,908 | 3/1995 | Kienle | 220/791 X |
| 5,407,107 | 4/1995 | Smith . | |
| 5,566,529 | 10/1996 | Sireix . | |
| 5,577,370 | 11/1996 | Pajak et al. . | |
| 5,669,550 | 9/1997 | Klemme et al. . | |
| 5,709,314 | 1/1998 | Petry | 220/802 |
| 5,722,562 | 3/1998 | Kick | 220/802 X |

INSERTED LID, BOX WITH SAID LID AND PROCESS FOR THE PRODUCTION OF SAID LID

The invention relates to inserted lids according to the precharacterizing clause of claim 1, to boxes with said lid and to a process for the production of such an inserted lid.

Such inserted lids have consisted to date either of plastic and have had a stop which points radially outwards and, in the inserted state, is supported on the open box edge as, for example, according to U.S. Pat. No. 4,088,242; they are problematic in terms of disposal.

The widely used cardboard boxes are in fact generally employed as packaging, which are disposed of after their intended use. To permit simple and economical recycling, the boxes and lids should be formed from only one and the same, readily recyclable material. This means that bases and lids, too, should be formed from cardboard and/or strong paper. In the case of boxes which are suitable for holding moist products or for products to be protected from moisture, in particular foods, for example cardboard boxes and cardboard lids with metal layers, in particular aluminium layers, but optionally also with plastic layers, are used.

Inverted and inserted lids of cardboard and paper have already been produced. Since the mounted lids must tightly seal the interior of the box, however, the use of cardboard and/or paper gives rise to problems because components of these layer materials cannot be produced with very great accuracy. The large tolerances which have to be expected are associated in particular with the fact that cardboard and/or paper react to environmental influences, in particular to different atmospheric humidities, with size changes. A known inserted lid comprises a flat closure surface of half-board or strong paper which, at its circular edge, is contiguous with a cylindrical contact region. The closure surface with the cylindrical contact region is produced from a flat material by a punching and pressing process. A cardboard cylinder section folded half-inwards is mounted at the free or open end of the contact region and fastened thereon by gluing. The folded-over cardboard cylinder section encloses a part of the contact region and forms, at its inner border, the grip rib and, at its outer border, the stop region placeable on the edge of the box opening. The adjacent contact regions of the lid and of the box must be dimensioned so that the lid can be inserted or removed, even in the case of different atmospheric humidities. On insertion of a lid in which the circumference of the contact region is slightly greater than the circumference of the box contact surface, the lid may be irreversibly deformed by the formation of, for example, creases in the contact region and in particular in the closure surface. To reduce moisture-related inaccuracies, the lid outer surfaces are provided, for example, with a moisture-repellent coating. Owing to material-related tolerances, however, the crease formation mentioned cannot be ruled out.

Inserted lids consisting of 3 or more cardboard parts, as, for example, according to U.S. Pat. No. 2,638,820, have already been proposed, or the formation of an inserted lid initially attached to the side wall of the box (DE-A1-4023996), by a procedure in which, after insertion of the closure surface, the side wall of the box is broken open along a circumferential ideal tear line, interrupted according to EP-A1-668,151 for forming a type of hinge, which however prevents the formation of a membrane passing over the box edge and requires a very exact cutting depth which is difficult to master industrially, in order to avoid damaging the closure membrane. Both are relatively inconvenient embodiments, the production of which is relatively expensive.

A better variant is described in DE-U-9319903; it is true that it avoids the problems with the exact cutting depth because the inserted lid is produced independently of the side wall of the box; however, the ring surrounding the closure membrane is formed in a complicated manner for making exact contact with the box edge.

It is the object of the invention to provide a box which has an inserted lid, is very economical to produce and does not have the stated problems; the contact region of the inserted lid should preferably always rest tightly against an annular region of the inner surface of the side wall of the box.

The object is achieved by realizing the features of the precharacterizing clause together with the characterizing features of claim 1, in particular in combination with the characterizing features of claim 2, and by the features of claim 10. Preferred embodiments are characterized by the features of the dependent Claims.

In achieving the object, it was recognized in particular that the contact region should be formed so that it could be pressed against the inside of the side wall of the box and hence, in the non-inserted state, be slightly larger than the box opening. On insertion of the lid into the box, the larger circumferential line of the contact region should adjust to the inside of the side wall of the box as a result of an elastic deformation of the closure surface. To prevent the forces emanating from the side wall of the box on insertion from leading to an irreversible deformation, the closure surface must have, radially with respect to the contact region, spring properties which permit an elastic deformation of the contact region in the radial direction. To ensure these spring properties, the closure surface has a shape differing from a flat surface. On insertion of the lid, this difference is slightly increased as a result of the compression of the contact region, which leads to restoring forces which press the contact region against the inside of the side wall of the box. Owing to the form imposed on the closure surface, it is ensured that no creases or other irreversible deformations form on insertion of the lid. In addition, this results in a radical improvement in the rigidity and the resistance to distortion of the lid.

If the closure surface is formed so that it is merely dome-shaped—with the highest point in the region of the centre of the closure surface—only small restoring forces emanate therefrom because the radii of curvature of the dome change only slightly on insertion of the lid. Where the tightness of the box closure has to meet low requirements, such a dome-shaped embodiment of the closure surface is sufficient. Waves, in particular concentric waves, which are embossed along the contact region in the closure surface, are closer to the contact region and undergo sufficiently large relative shape changes even in the case of small radial movements of the contact region, in order to generate spring forces of a higher order of magnitude. Waves are understood as meaning all possible bulges or indentations—essentially a constant distance from the contact surface—in the closure surface. Preferably, these waves extend along a closed line. However, embodiments in which the individual waves are pronounced only along sections of a closed line are also possible.

Lids according to the invention may be provided both for boxes with circular openings and for boxes having openings of other shapes, in particular rectangular or hexagonal openings, especially having rounded corner regions. In the case of circular box openings and correspondingly formed contact regions, the waves, too, are preferably circular and arranged concentrically. In the case of contact regions having essentially circumferential lines approximating to polygons, the preferred wave lines are in the region of polygonal or circular lines. Preferred embodiments achieve the desired spring properties by the use of two waves side by side essentially a constant distance from the contact region.

As a result of the spring action of the closure surface or its shape differing from a plane, it is ensured that the contact region always rests tightly against an annular region of the inner surface of the side wall of the box. A further advantage of the spring action thus generated is that, as a result of age-related flattening of the closure surface or of the waves applied therein, the seal is not diminished but increased.

It would also be possible to form, in the contact region, a wave which would be flattened on insertion of the lid. However, the disadvantage of such a wave would be that the sealing effect would be lost with fatigue-related or age-related flattening of this wave.

During the production of an inserted lid according to the invention, the closure surface having an edge region which projects outwards and is preferably also slightly conical in an outward direction is first cut out in a punching and pressing process; in particular, the edge region is shaped to be conical or optionally cylindrical for the formation of the contact region; the closure surface is brought into a form differing from a plane by pressing or embossing. The closure surface is then passed through a cardboard cylinder section which rests on a die whose hole diameter corresponds approximately to the internal diameter of the cardboard cylinder section, until only the uppermost part of the contact region rests from inside against the lower region of the cardboard cylinder section and can be connected thereto. The cardboard cylinder section is connected to the contact region by heat sealing, preferably in a manner known per se by heatable expanding segments or the like, optionally also by gluing or, for example, by means of a bead. The disadvantage of using glue is that glue applied to the areas to be connected can be scraped off during passage of the closure surface through the cardboard cylinder section. In the case of seal seams and optionally also in the case of glued joints, a press apparatus having press parts which can be pressed outwards, in particular one which emits heat for heat sealing, is preferably used. The press part having a convex press surface can be moved from a feed position with a smaller press surface circumference to a pressing position having a larger circumference. The press parts can be dimensioned so that, when resting against one another, they form a step-free, closed circumferential line.

Further details of the invention are evident from the following description of embodiments illustrated in the drawings.

Figure 1:
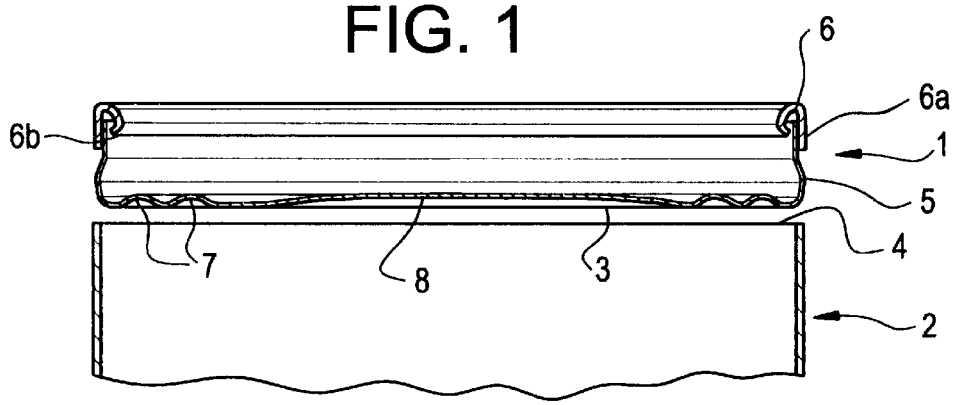
FIG. 1 shows a vertical section through the upper box end and through the lid, held above it, of a preferred embodiment of the invention.

FIG. 1 shows an inserted lid 1 of cardboard, half-board or strong paper for a box 2. The inserted lid 1 consists of a closure surface 3 which extends over the cross-section of a box opening 4 and, as a result of a bend through essentially 90°, becomes a contact region 5 in its outer area. A cardboard cylinder section 6—preferably comprising an obliquely wound tube, in particular of the same cross-section as the side wall of the box 2—is fastened, at least with its first end region 6*a*, to the free or open end of the contact region 5, preferably to a part of its outer surface. The first end region 6*a* has the same opening cross-section as the box 2 which can be closed with the lid 1, so that, on insertion of the lid, this first end region 6*a* acts as a stop region which can be placed against the edge of the box opening. The second end region 6*b* of the cardboard cylinder section 6 is bent or rolled inward to form a grip rib. In the embodiment shown, the connection of the contact region 5 to the cardboard cylinder section 6 is in the form of a seal seam. It would also be possible to form this connection as a bead connection.

Two annular, concentrically arranged waves 7 and a central dome-shaped vault 8 optionally directed towards the end region with the grip rib are formed in the closure surface 3. However, it may be preferable to direct the dome-shaped vault towards the interior of the box (not shown) because then, on insertion of the relatively tightly sealing lid, the vault reinforces the pressure on the contact region and/or flips upwards as a result of the pressure on the space between the lid and any membrane foil (not shown) (or by the pressure inside the can after opening or removal of said foil by the consumer). In the embodiment shown, the two waves 7 are present in the outer edge region of the closure surface 3, the distance from the outermost wave to the contact region essentially corresponding to the wave width. The waves 7 and the vault 8 are so pronounced that, directly after transition from the closure surface 3 to the contact region 5, the contact region 5 projects slightly above the border 4 of the opening of a box 2 to be closed. On insertion of the lid 1, this projecting region is pressed inwards; the waves 7 and the vault 8 are made fairly strong and thus—in the manner of a compressed spring—generate a restoring force which presses the contact region against the inside of the side wall of the box.

Figure 2:
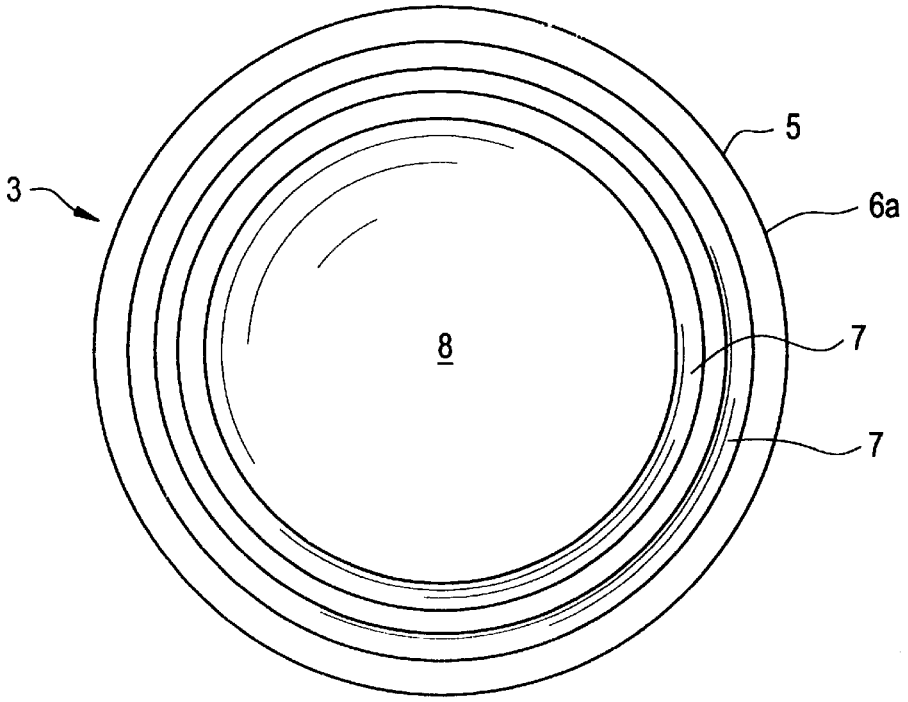
FIG. 2 shows a lid according to the invention in a view from below.
Figure 3:
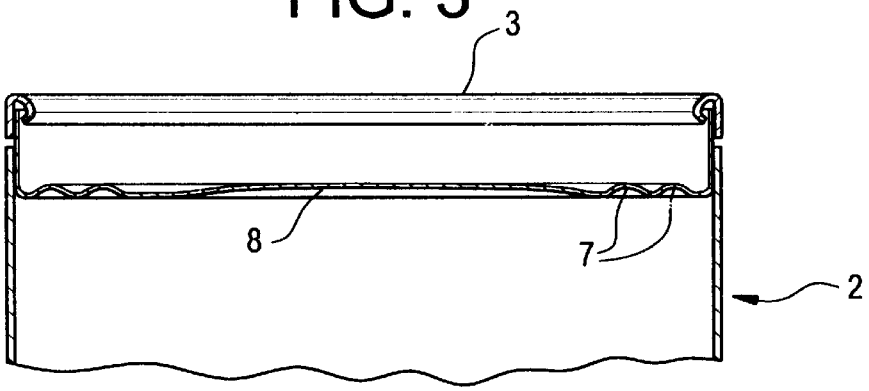
FIG. 3 shows a vertical section through the upper box end and inserted lid.

FIG. 2 shows the concentric waves 7 and FIG. 3 shows the waves 7 under stress after insertion of the lid 3 and the slightly raised vault 8.

Figure 4:
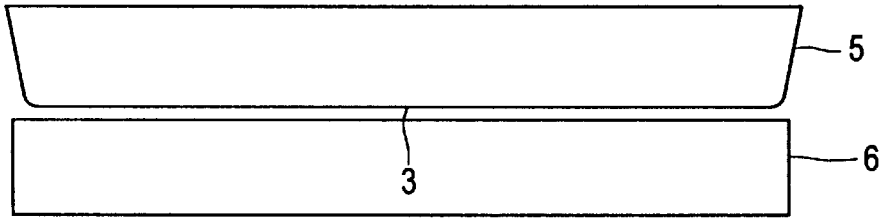
FIG. 4 shows the side view of a closure surface having a conically upward projecting contact region and cardboard cylinder section underneath.
Figure 5:
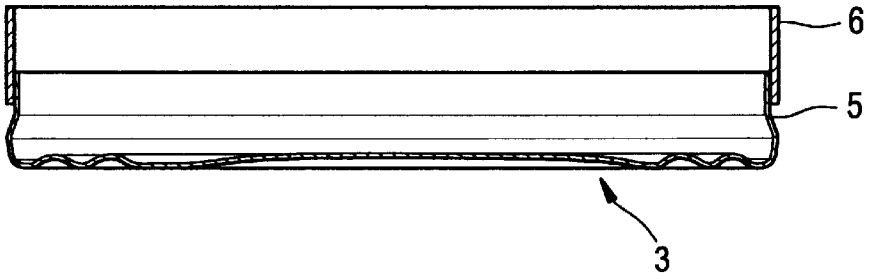
FIG. 5 shows a vertical section through the cardboard cylinder section with inserted closure surface.

A closure surface 3 having a conical contact region 5 is shown in FIG. 4 during insertion into a cardboard cylinder section 6 and in FIG. 5 after sealing with the cardboard cylinder section 6. The free end of the cardboard cylinder section is then bent over or rolled inwards. The cardboard cylinder section 6 is preferably cut from the same tube as the side wall of the box and can be wound spirally or parallel.

Figure 6A:
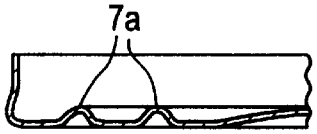
FIG. 6 shows parts of vertical sections through inserted closure surfaces.
Figure 6B:
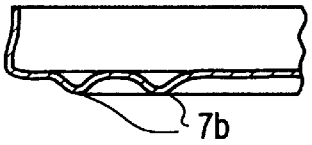
Figure 6C:
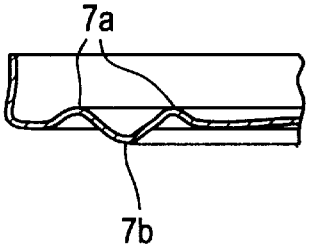

FIG. 6*a* shows waves 7*a* formed in an upward direction, FIG. 6*b* shows waves 7*b* formed in a downward direction and FIG. 6*c* shows a combination of waves 7*a* and 7*b* formed in an upward and downward direction, respectively. Of course, various wave shapes and combinations of waves can be used provided that they make the desired spring connection achievable.

Figure 7:
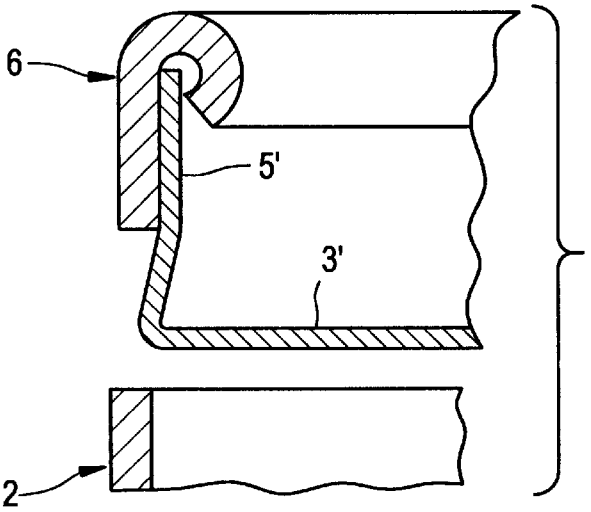
FIG. 7 shows a vertical section through a side of the upper box end and of the lid, held above it, of the standard embodiment of the invention.

FIG. 7 shows the standard embodiment of the invention on a slightly larger scale, with a closure surface 3' whose vertical edge region 5' is surrounded by a cardboard cylinder section 6 whose upper edge is bent inwards to form a grip rib (this is shown in a manner analogous to FIG. 1).

Figure 8:
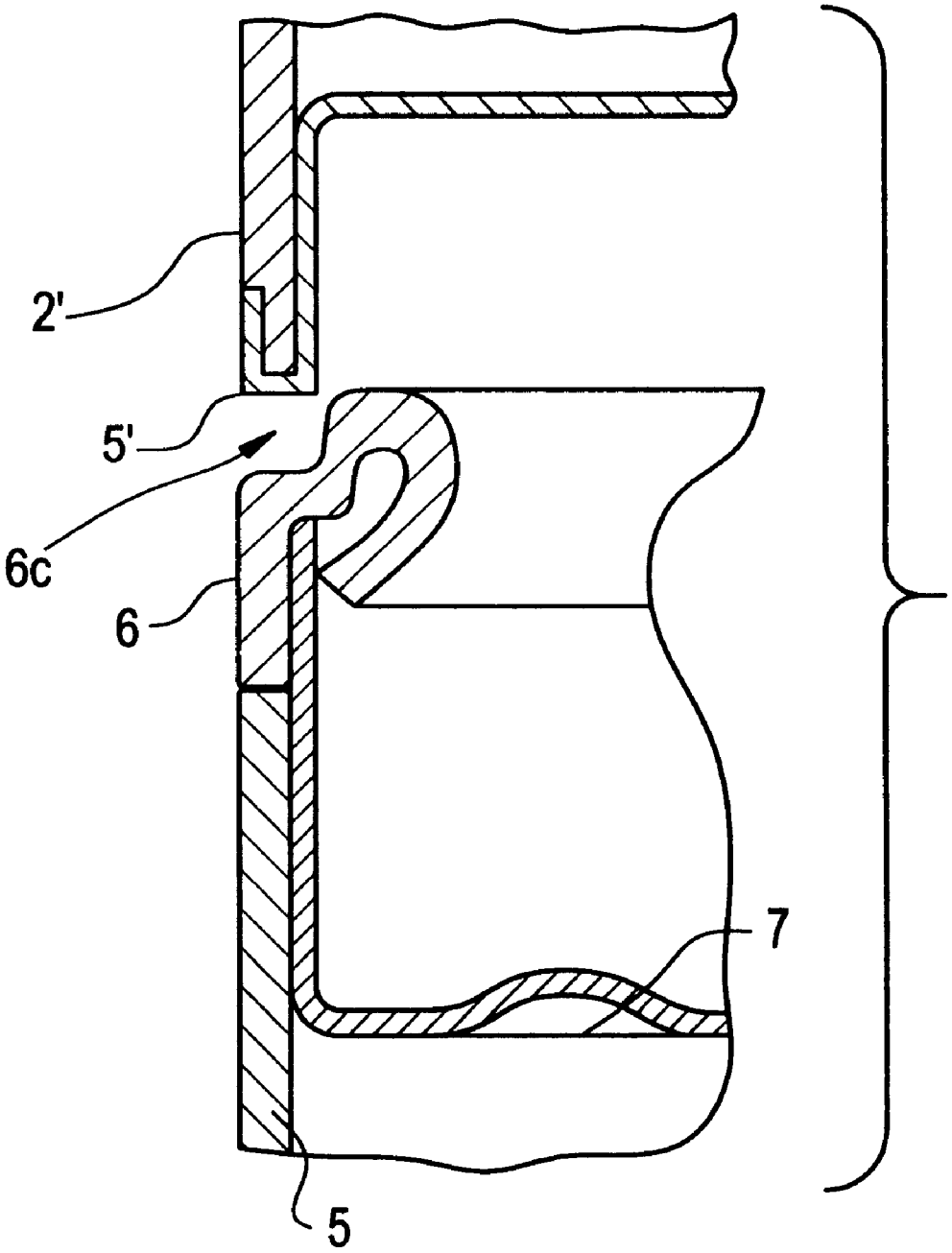
FIG. 8 shows a vertical section through a side of the upper end of a box with a base, held above it, of a second box to be stacked thereon.

FIG. 8 shows the provision or a stacking bead 6*c* on the upper edge of the cardboard tube section 6 and the lower end 2', 5' of a second box to be stacked thereon, which lower end is arranged over the side wall 2 of the box.

What is claimed is:

1. Box with an inserted lid both of which consist of cardboard, half-board or strong paper, the box comprising a cylindrical box body cut from a tube and having at least one end which is to receive the inserted lid, the lid comprising (i) a closure portion overspanning the cross section of the box body at a distance from said end, (ii) a cylindrical contact region extending from the circumference of said closure portion towards said end, having a height essentially equal to said distance and having a diameter essentially equal to the one of the box body, and (iii) a cardboard cylinder section cut from a separate tube equal to the one of the box body and surrounding the free or open end of said contact region such that a first end of said cardboard cylinder section rests against said end of the box body while a second end of said cardboard cylinder section is bent inwards to form a grip rib.

2. Box (2) having an inserted lid (1) according to claim 1, characterized in that the closure surface (3) is formed with a shape differing from a flat surface and thus acts as a spring element for the contact region (5) adjacent to the closure surface (3), which spring element makes it possible for said contact region to be pressed against the inner surface of a side wall of a box.

3. Box (2) having an inserted lid (1) according to claim 1, characterized in that the contact region (5) is formed to be cylindrical and the closure surface (3) is formed to be rotationally symmetrical.

4. Box (2) having an inserted lid (1) according to claim 1, characterized in that the closure surface (3) comprises a dome-shaped vault (8), preferably directed towards the interior of the box.

5. Box (2) having an inserted lid (1) according to claim 1, characterized in that the closure surface (3) comprises at least one wave (7)—essentially a constant distance away from the contact region (5).

6. Box (2) having an inserted lid (1) according to claim 5, characterized in that a distance from an outer wave (7) to the contact region (5) essentially corresponds to a wave width and preferably at least one further wave (7) is present within the first wave and is preferably concentric therewith.

7. Box (2) having an inserted lid (1) according to claim 1, characterized in that the contact region (5) projects above the border (4) of the opening of the box (2) directly after the transition from the closure surface (3).

8. Box (2) having an inserted lid (1) according to claim 1, characterized in that the closure surface (3) and the contact region (5) are coated with a protective layer, preferably with aluminium or plastic.

9. Box (2) having an inserted lid (1) according to claim 1, characterized in that the cardboard cylinder section (6) has a stacking bead (6*c*) at its upper edge.

10. Process for the production of an inserted lid (1) for a box (2) having an inserted lid (1) according to claim 1, in which first, in a punching and pressing process, the closure surface (3) is cut out with an outward-projecting edge region and the edge region is shaped conically or optionally cylindrically to form the contact region (5), characterized in that, in the punching and pressing process, the closure surface (3) is formed, for example by pressing or embossing, into a shape differing from a flat surface, in particular having a dome (8) and/or having at least one wave, but preferably having at least two waves (7), whereupon the contact region (5) is connected to the cardboard cylinder section (6).

11. Process according to claim 10, characterized in that the closure surface (3) is passed through a cardboard cylinder section (6) until only a part of the contact region (5) is pressed from inside against the cardboard cylinder section (6) and is connected thereto.

12. Process according to claim 10, characterized in that a press apparatus which has elements which can be pressed outwards and preferably emits heat to permit heat-sealing is used for joining a part of the contact region (5) to the corresponding region of the cardboard cylinder section (6).

* * * * *